US006059661A

United States Patent [19]

Simpson

[11] Patent Number: 6,059,661

[45] Date of Patent: May 9, 2000

[54] SHAFT ALIGNMENT

[75] Inventor: Neil Andrew Abercrombie Simpson, Aberdeen, United Kingdom

[73] Assignee: Japan National Oil Corporation, Tokyo, Japan

[21] Appl. No.: 08/754,956

[22] Filed: Nov. 22, 1996

[30] Foreign Application Priority Data

Nov. 22, 1995 [GB] United Kingdom ..... 9523901

[51] Int. Cl.[7] ..... E21B 17/02

[52] U.S. Cl. ..... 464/19; 464/178

[58] Field of Search ..... 464/19, 160, 170, 464/178, 185

[56] References Cited

U.S. PATENT DOCUMENTS

| | | | |
|---|---|---|---|
| 2,684,581 | 7/1954 | Zubin | 464/19 |
| 2,696,264 | 12/1954 | Colmerauer et al. | 464/19 |
| 2,717,146 | 9/1955 | Zubin | 464/19 |
| 3,260,069 | 7/1966 | Neilson et al. | 464/19 |
| 4,243,112 | 1/1981 | Sartor | 464/19 |
| 4,286,676 | 9/1981 | Nguyen et al. | 464/19 |
| 4,290,494 | 9/1981 | Blanz | 464/19 |
| 4,343,369 | 8/1982 | Lyons et al. | 464/19 |
| 4,430,905 | 2/1984 | Brugera | 464/178 |
| 4,694,914 | 9/1987 | Obrecht . | |
| 5,495,900 | 3/1996 | Falgout, Sr. . | |

FOREIGN PATENT DOCUMENTS 1494273 12/1977 United Kingdom .

*Primary Examiner*—Lynne H. Browne
*Assistant Examiner*—Greg Binda
*Attorney, Agent, or Firm*—Jacobson, Price, Holman & Stern, PLLC

[57] ABSTRACT

A rotary shaft assembly including a mechanism by which one part of the shaft rotates about a rotation axis which is controllably deviated from the rotation axis of the other part of the shaft. The angular extent of deviation is controllably varied by mutually rotating adjacent shaft supports about an axis which is at a non-zero angle with respect to both rotation axes. The direction in which the shaft is deviated is controlled by rotating the non-deviated shaft support with respect to a reference shaft support. The assembly includes remote control of direction and deviation and is is particularly applicable to drilling of deviated wells. Further, the assembly includes a remotely actuated and de-actuated temporary anchoring system for downhole direction sensing and deviation adjustment.

6 Claims, 11 Drawing Sheets

206
301
301

250
317
315

325
323
321
317
250
206
327

327

250
315
232
313
206
303
301
303
305
307
311
309
232

SHAFT ALIGNMENT

This invention relates to shaft alignment, and relates more particularly but not exclusively to alignment of the downhole end of a drillstring for directional drilling of a well in geological formations.

BACKGROUND OF THE INVENTION

Currently, a large majority of directional drilling is carried out in the smaller hole sizes, ie 8.5 inches or less (216 millimeters or less). In recent years, considerable interest in cost reduction and in increased productivity from marginal fields has led to a greater requirement for the drilling of high angle wells and horizontal wells. Additionally, the realisation that formation damage had a more significant effect on productivity than had previously been appreciated is causing a rapidly expanding interest in coiled tubing drilling, such that coiled tubing drilling has now overtaken slim hole drilling in respect of re-entry well work.

Control of direction when drilling is necessary but may be difficult, particularly in the smaller hole sizes. Direction control techniques available for larger hole sizes where the string is nominally rigid and can transmit high torque together with high longitudinal forces are not available for use in the relatively small diameter coiled tubing systems where the casings are flexible and cannot sustain high forces.

SUMMARY OF THE INVENTION

According to the first aspect of the present invention there is provided a shaft alignment system comprising a first shaft support means having a first longitudinal axis and a second shaft support means having a second longitudinal axis, bearing means rotatably coupling said first shaft support means to said second shaft support means, said bearing means having a bearing rotation axis, said bearing means being arranged with respect to said first and second shaft support means such that said bearing rotation axis is aligned at a first non-zero angle with respect to said first longitudinal axis and at a second non-zero angle with respect to said second longitudinal axis whereby relative rotation of said first and second shaft support means about their respective longitudinal axes varies the relative angular alignment of said first and second longitudinal axes.

BRIEF DESCRIPTION OF THE DRAWINGS

Embodiments of the invention will now be described by way of example with reference to the accompanying drawings, wherein.

DESCRIPTION OF PREFERRED EMBODIMENTS

Figure 1A:
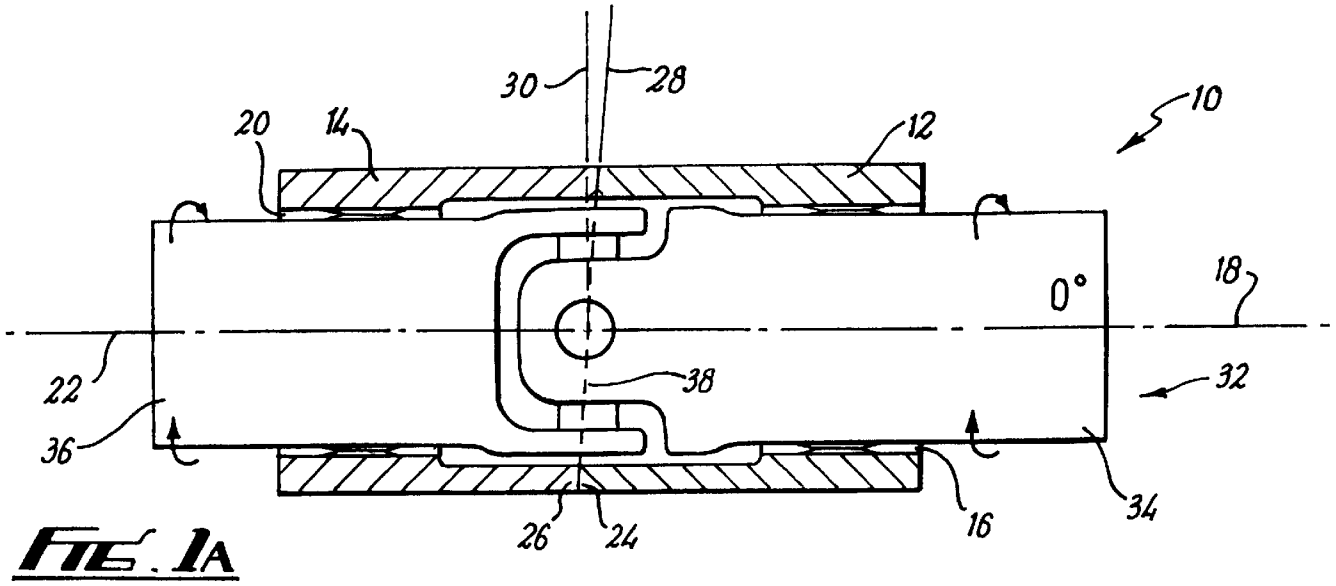
FIG. 1A is a longitudinal section of a first embodiment of alignable shaft assembly illustrating the principles of the invention and configured in an "unbent" condition.

Referring first to FIG. 1A, an alignable shaft assembly 10 comprises a first shaft support 12 and a second shaft support 14. The first shaft support 12 is a hollow tubular component internally fitted with a rotary bearing 16 which has a rotational axis coaxial with the longitudinal axis 18 of the first shaft support 12. The second shaft support 14 is another hollow tubular component internally fitted with a respective rotary bearing 20 which has a rotational axis coaxial with the longitudinal axis 22 of the second shaft support 14.

The first and second shaft supports 12 and 14 abut along respective end faces 24 and 26.

The shaft supports 12 and 14 are mutually rotationally coupled by a bearing (not shown) which allows relative rotation between the supports 12 and 14 while keeping their end faces 24 and 26 in mutual contact. The axis of rotation of this support-coupling bearing is aligned with a small but non-zero angle to each of the longitudinal axes 18 and 22. In FIG. 1A, this angular configuration is denoted by the plane 28 of abutment of the end faces 24 and 26 being at the same small but non-zero angle with respect to a notional plane 30 which is exactly at right angles to both the longitudinal axes 18 and 22 (which are coaxial in the particular configuration of the assembly 10 that is shown in FIG. 1A). In the exemplary arrangement shown in FIG. 1A, the small non-zero angle is 2 degrees.

The assembly 10 further includes a shaft 32 comprising a first shaft section 34 and a second shaft section 36. The first shaft section 34 is rotatably supported in the rotary bearing 16 for rotation about a first shaft rotation axis coaxial with the longitudinal axis 18 of the first shaft support 12. The second shaft section 36 is rotatably supported in the rotary bearing 20 for rotation about a second shaft rotation axis coaxial with the longitudinal axis 22 of the second shaft support 14. The first and second shaft sections 34 and 36 are mutually coupled for conjoint rotation by means of a shaft coupling 38 of the type capable of indefinitely sustained rotation between and rotationally coupling respective rotary shafts whose respective rotational axes mutually intersect but which are non-parallel. As shown in FIG. 1A for the purposes of this simplified explanation of the principles of the present invention, the shaft coupling 38 is of the type known as a "universal joint" or Hooke joint (as commonly employed in cardan shafts, eg the transmissions of road vehicles which link gearbox to rear axle). However, for reasons which will subsequently be explained, the preferred form of the shaft coupling 38 is a coupling of the type shown as d "constant-velocity joint" (ie a coupling transmitting rotation without cyclic variations in the angle between input and output, such as a Rzeppa joint or similar joints used in the hubs of front-wheel-drive road vehicles). Alternatively, the shaft 32 could be formed as a unitary item with a flexible central section capable of transmitting rotation between ends which are aligned or variably non-aligned. Additionally, for further reasons which will also be explained subsequently, it is preferred that the shaft sections 34 and 36 are hollow and mutually linked by a coupling 38 (of whatever form) which is also hollow to form a shaft 32 which is capable of carrying pressurised fluid through the length of the shaft.

Figure 1B:
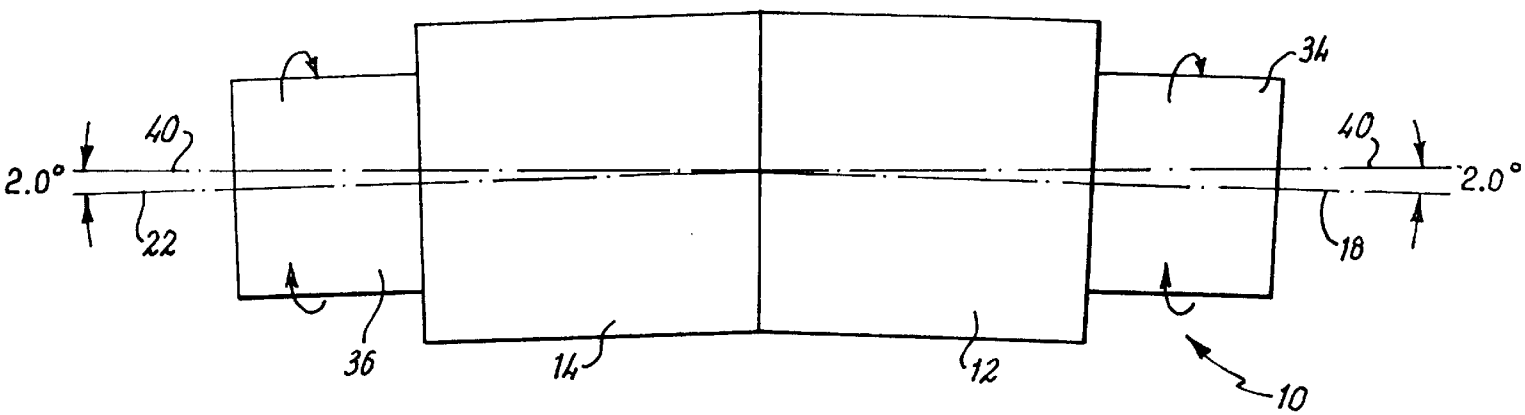
FIG. 1B is an elevation of the first embodiment of FIG. 1A, reconfigured to a "bent" condition.

With the shaft supports 12 and 14 mutually rotationally aligned as shown in FIG. 1A, the respective longitudinal axes 18 and 22 are mutually coaxial and undeviated, by reason that the inclinations of the end faces 24 and 26 mutually cancel out (as will subsequently be explained in greater detail). However, if the shaft supports 12 and 14 are mutually rotated by 180 degrees to the configuration shown in FIG. 1B (with the support-coupling bearing keeping the inclined end faces 24 and in mutual contact at all times), the assembly 10 becomes "bent" and each of the longitudinal axes 18 and 22 becomes deviated by 2 degrees with respect to the rotational centre-line 40. In this "bent" configuration, the shaft section 36 can still be rotated by rotation of the shaft section 34 (since the two shaft sections 34 and 36 are mutually coupled for conjoint rotation by means of the shaft coupling 38), but the axis of rotation of the shaft section 36 (which is, at all times, coaxial with the longitudinal axis 22 of the second shaft support 14) is now deviated by 4 degrees from the axis of rotation of the shaft section 34 (which is, at all times, coaxial with the longitudinal axis 18 of the first shaft support 12).

The above-described shaft deviation of 4 degrees is the maximum that can be achieved with the assembly 10, wherein the angular deviation of the end faces 24 and 26 with respect to the longitudinal axes 18 and 22 (ie the angle between planes 28 and 30) is 2 degrees. Shaft deviations in the range 0 degrees to 4 degrees can be selected by relatively rotating the shaft supports 12 and 14 by amounts in the range 0 degrees to 180 degrees. The shaft deviation will vary in cycles between zero and maximum with each 180 degrees of support rotation. Different deviation maxima can be predetermined by forming the assembly with a different deviation angle in the axis of the support-coupling bearing.

The direction in which the shaft section 36 is deviated with respect to the shaft section 34 can be controlled by rotating the first shaft support 12 about the longitudinal axis 18 with respect to a fixed reference direction (eg North) until the support 12 is suitably directed, and then rotating the second shaft support 14 about its own longitudinal axis 22 with respect to the first shaft support 12 until the intended shaft deviation has accrued, the rotational direction of the support 12 being such that the support 14 (and the shaft section 36 rotatably carried by the support 14) is deviated in the intended direction. Arrangements for carrying out directional control as well as deviation control will be described subsequently.

It should be noted that in normal use of the assembly 10, the shaft supports 12 and 14 will undergo intentional rotation only during changes in deviation and/or direction, and the shaft supports 12 and 14 will be static (except for possible longitudinal movement) whereas the shaft 32 will undergo sustained rotation (eg for the purpose of well drilling, as will as exemplified below).

Figures 2A, 2B, 2C:
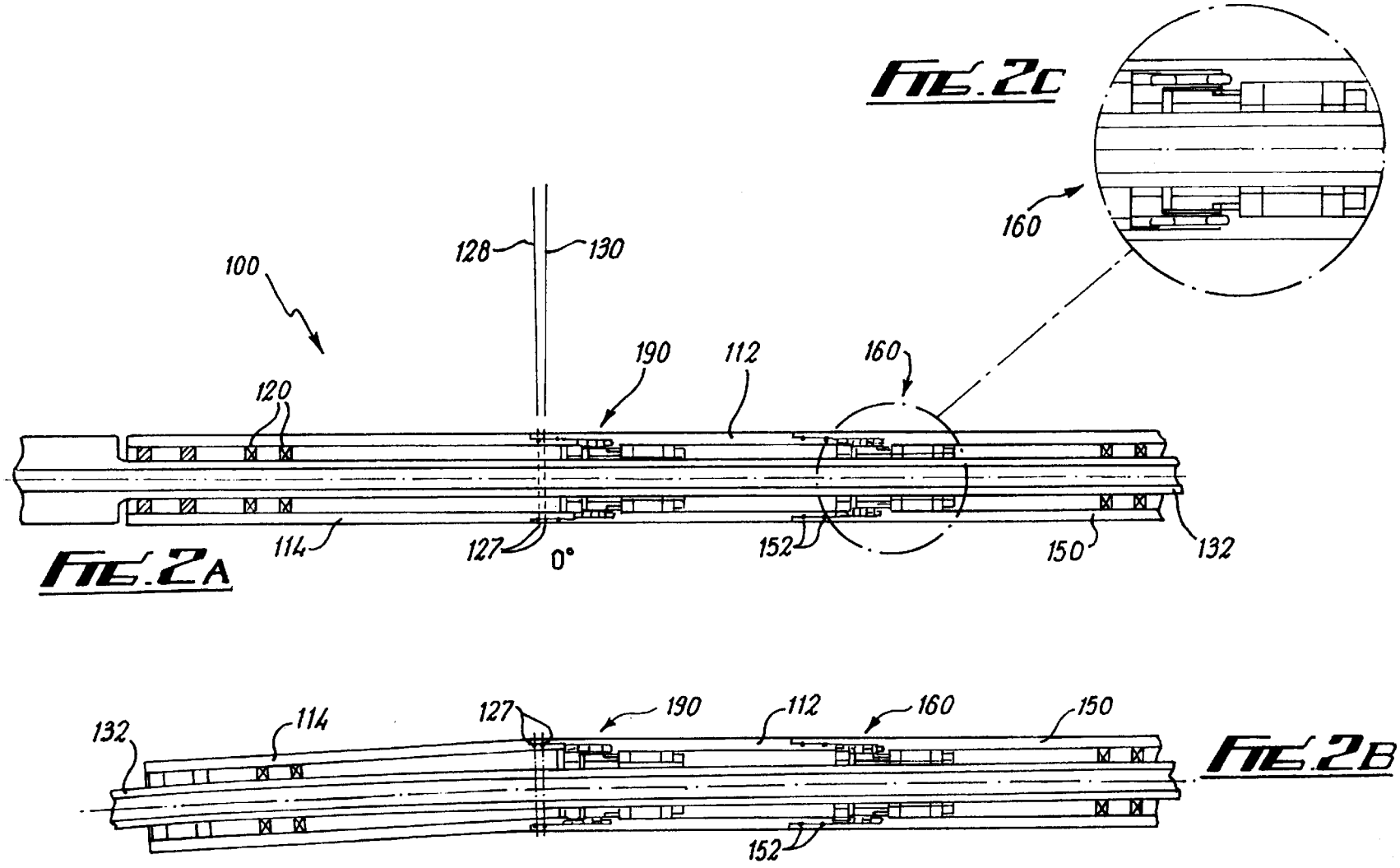
FIG. 2A is a longitudinal section of a second embodiment of alignable shaft assembly, configured in an "unbent" condition.
FIG. 2B corresponds to FIG. 2A but shows the second embodiment reconfigured to a "bent" condition.
FIG. 2C is a fragmentary view of parts of the second embodiment of FIG. 2A, to an enlarged scale.

Referring now to FIGS. 2A and 2B these show a preferred embodiment 100 of alignable shaft assembly which utilises the same general principles as the simplified embodiment 10 (described above with reference to FIGS. 1A and 1B) but which includes certain structural details to produce a more practicable arrangement. Components and sub-assemblies of the preferred embodiment of FIGS. 2A and 2B which are identical or equivalent to components or sub-assemblies of the simplified embodiment of FIGS. 1A and 1B will be given the same reference numeral but preceded by a "1" (ie certain of the reference numerals in FIGS. 2A and 2B are the corresponding reference numerals from FIGS. 1A and 1B, plus "100"). The following description of the preferred embodiment of FIGS. 2A and 2B will concentrate on features differing from the simplified embodiment of FIGS. 1A and 1B, and hence for a full description of any part of the preferred embodiment not dealt with below, reference should be made to the foregoing description of the identical or equivalent parts of the simplified embodiment.

In the preferred embodiment as shown in FIGS. 2A and 2B (which correspond in terms of configuration and "bend" with FIGS. 1A and 1B respectively), the principal difference lies in the provision of a further support 150 which is a hollow tubular member that rotationally supports the first shaft support 112 by means of a rotary bearing 152. Unlike the bearing (shown as a rotary bearing 127 in this embodiment) which rotationally couples the second shaft support 114 to the first shaft support 112, the bearing 152 has a rotation axis which is coincident with the longitudinal axes of the supports 112 and 150. This coincidence of axes ensures that rotation of the support 112 with respect to the farther support 150 does not induce deviation of the support 112 with respect to the further support 112.

The rotation axis of the bearing 127 is deviated by 1½ degrees from the longitudinal axes of the supports 112 and 114, such that the maximum shaft deviation in this preferred embodiment is 3 degrees (see FIG. 2B).

In the embodiment of FIGS. 2A and 2B, the shaft 132 is a unitary construct having sufficient flexibility to cope with the maximum deviation and still have adequate ability to transmit rotational power. Excessive curvature of the shaft 132 in its maximum bend configuration (see FIG. 2B) is avoided by omission of shaft bearings from the support 112.

By anchoring the further support 150 (eg by use of the anchoring means subsequently described with reference to FIGS. 4A, 4B, 5 and 5A), the support 112 can be rotated relative to the now-fixed support 150 until a selected direction is reached, and the support 114 can be rotated relative to the support 112 until a selected deviation (in the range 0 degrees to 3 degrees) is reached.

The assembly 100 is provided with two sets 160 and 190 of relative rotation control means for respectively power driving the relative rotation of the support 112 with respect to the support 150, and power driving the relative rotation of the support 114 with respect to the support 112. The rotation control set 160 couples the support 112 to the support 150, and is shown in enlarged detail in FIG. 2C. The rotation control set 190 couples the support 114 of the support 112, and is identical to the set 160 apart from one additional feature which will be mentioned subsequently. Accordingly, the following description of the rotation control set 160 applies also to the set 190 (apart from the additional feature in the set 190).

Figure 2D:
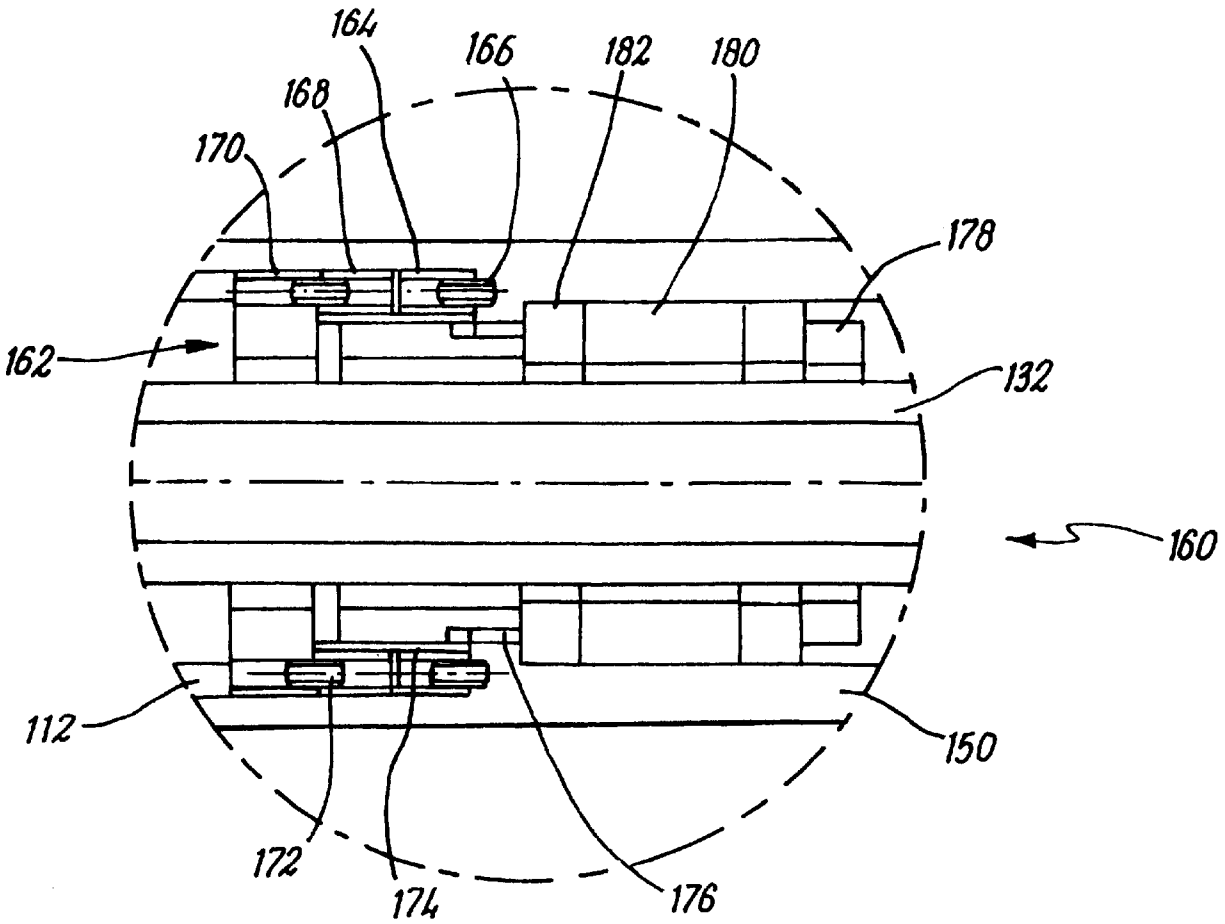
FIG. 2D shows the same view as FIG. 2C, to a much enlarged scale.

Reference will now be made to FIG. 2D, which is a much enlarged version of FIG. 2C. The relative rotation control set 160 comprises a harmonic gearbox 162 of the type known as "HDUR-IH Size 20" produced by Harmonic Drive Ltd (GB), and shown separately in FIG. 3. An internally-toothed spline ring 164 is secured to the further support 150 by means of grub screws 166. An internally-toothed spline ring 168 is secured to the support 112, via a drive ring 170, by means of grub screws 172. The internally-toothed spline rings 164 and 168 have slightly different numbers of teeth, and are simultaneously engaged by a common flexspline annulus 174 having external teeth which mesh with the internal teeth in the rings 164 and 168. The flexspine annulus 174 is rotated around the inside of the spline rings 164 and 168 by means of a wave generator 176 in the form of an eccentric rotated around the common axis of the gearbox 162. By known techniques this causes rotation of the spline ring 168 (and hence of the support 112) relative to the spline ring 164 (and hence to the support 150) at a rotational rate which is very much less than the rotational rate of the wave generator 176, ie the harmonic gearbox 162 has a very high reduction ratio (typically 160:1).

The generally annular form of the harmonic gearbox 162 facilitates its use in the tubular assembly 100, with the inherent high reduction ratio being particularly suited to the needs of the assembly 100. In particular, the shaft 132 can comfortably pass through the hollow centre of the gearbox 162.

Power to rotate the wave generator 176 is tapped from the shaft 132 through an Oldham coupling 178 (to allow for eccentricity of the shaft 132 which occurs during "bend" conditions such as are shown in FIG. 2B) and controlled by a clutch/brake unit 180 as dictated by a rotation sensor 182 coupled to the wave generator 176 to sense its number of revolutions, and hence the fraction of a revolution by which the support 112 is correspondingly rotated.

As already mentioned, the relative rotation control set 190 is the same as the set 160, except that the drive ring 170 is substituted by a rotation-transmitting coupling capable of working at deviations up to the maximum produced by the relative rotation of the supports 114 and 112 (as produced by operation of the set 190; see FIG. 2).

Figure 3:
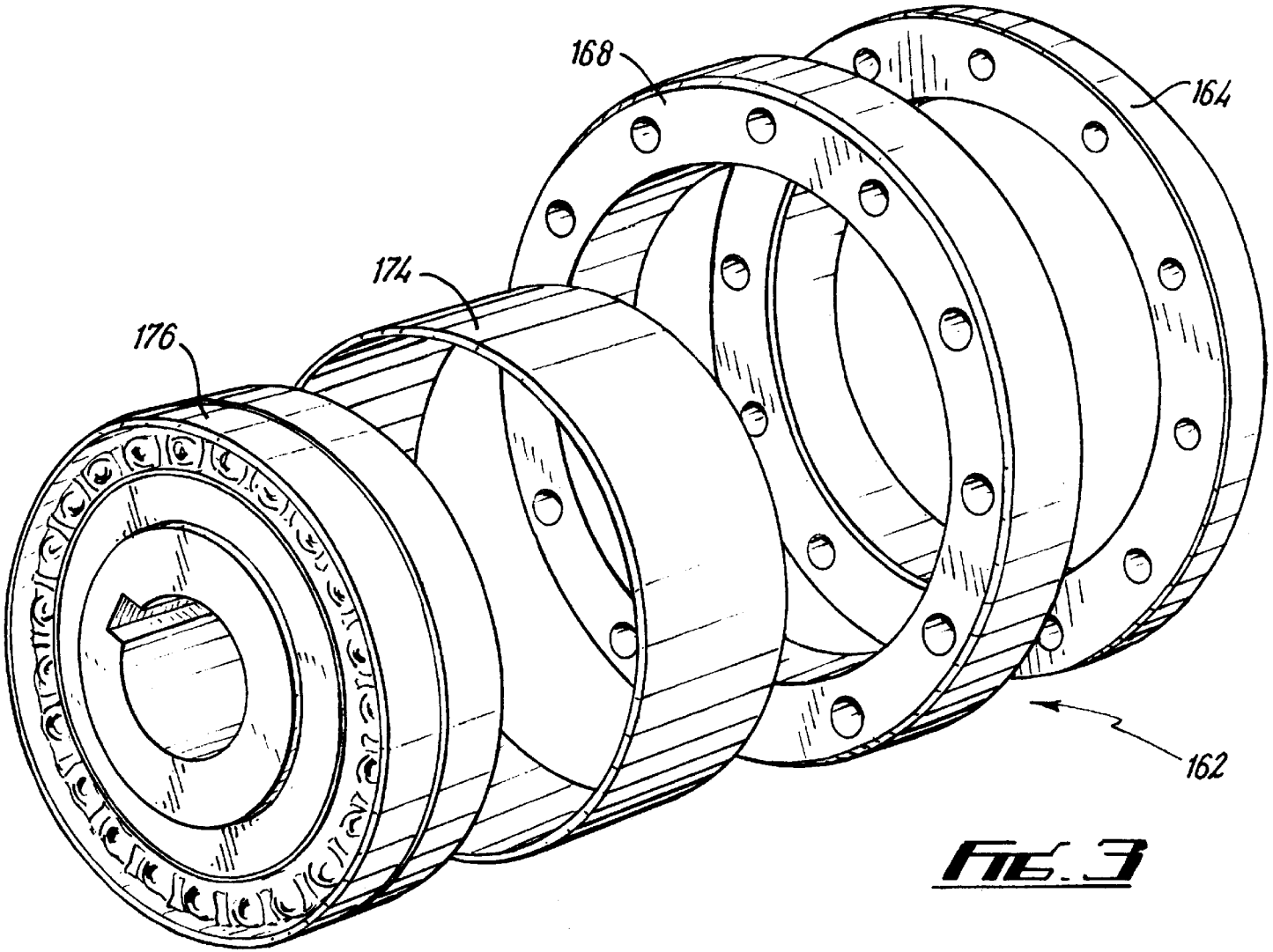
FIG. 3 is an exploded perspective view, to a much enlarged scale, of a gearbox employed in the second embodiment.

The essential components of the harmonic gearbox are shown in exploded perspective view in FIG. 3. In the gearbox version illustrated in FIG. 3, the wave generator 176 is an eccentric with a bearing-mounted flexspline-driving periphery; the hub of the eccentric would be bored out to suit the circumstances of use in the assembly 100.

Figure 4A:
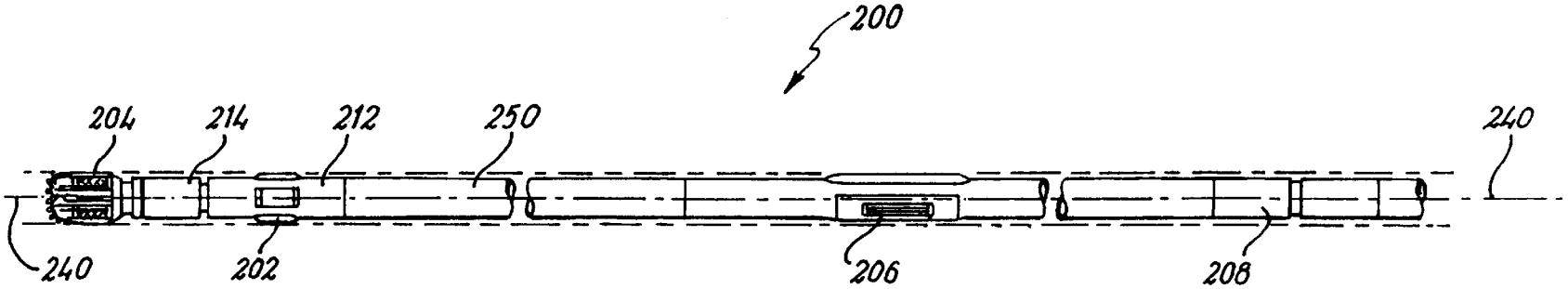
FIG. 4A is a longitudinal view of a directional drilling alignment assembly, configured in an "unbent" condition.
Figure 4B:
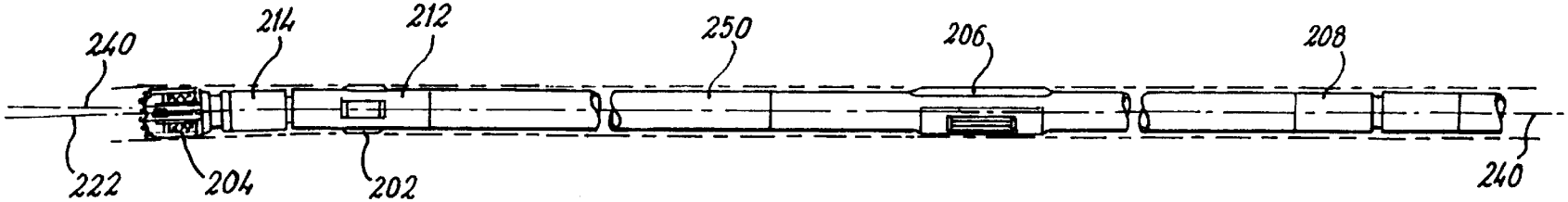
FIG. 4B corresponds to FIG. 4A but shows the assembly reconfigured to a "bent" condition.

A preferred use of the alignable shaft assembly of the invention is as a directional drilling system, of which a preferred embodiment 200 is depicted in FIGS. 4A and 4B (which correspond to FIGS. 2A and 2B respectively). The convention for reference numerals used in FIGS. 4A and 4B with respect to FIGS. 2A and 2B is the same as the convention for reference numerals used in FIGS. 2A and 2B with respect to FIGS. 1A and 1B.

Referring to FIG. 4A, the support 212 is externally fitted with an undergauged near-bit stabiliser 202, and the free end of the shaft 232 is fitted with a drill bit 204 where it projects from the support 214. The further support 250 is considerably extended in its longitudinal direction, and includes a radially expansible stabiliser 206 operable for temporary anchoring of the support 250 in order to establish a stable reference direction for correctly aligning the support 212, as determined by an azimuth sensor (not shown) or other suitable instrumentation built-in to the longitudinally extended support 250. Control signals can be delivered to the system 200 by way of a built-in communications link 208.

Once the support 212 has been correctly rotated to the required direction, the support 214 is rotated relative to the support 212 to produce the required deviation for further drilling, as depicted in FIG. 4B.

Parts of the system 200 adjacent to the stabilizer 206 are shown to an enlarged scale in FIG. 5 to which reference will now be made.

Figures 5, 5A, 5B, 6, 7:
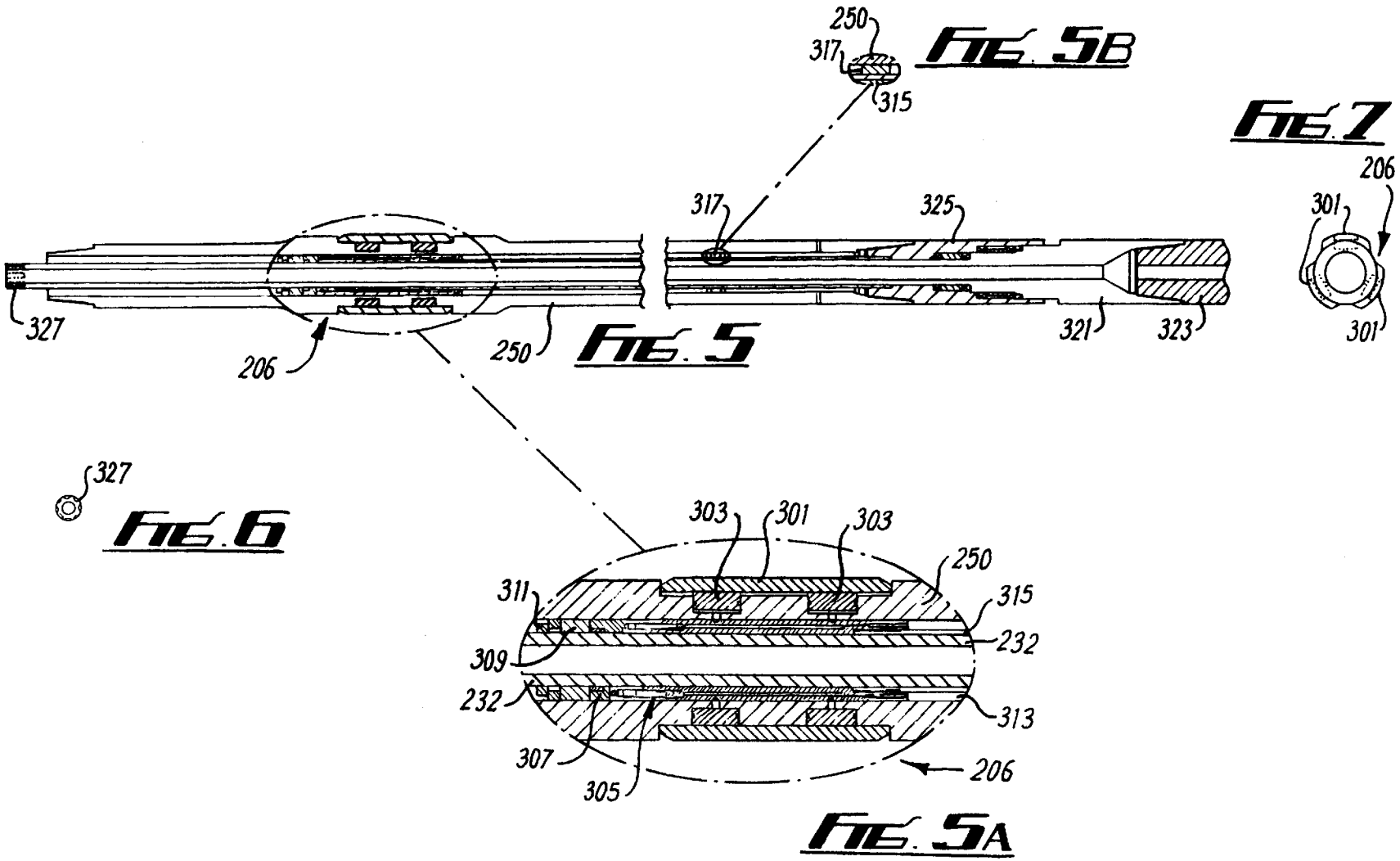
FIG. 5 is a longitudinal section of part of the assembly of FIG. 4A, to an enlarged scale.
FIG. 5A is a sectional elevation of a fragment of the assembly part shown in FIG. 5, to a much enlarged scale.
FIG. 5B is a sectional elevation of another fragment of the assembly part shown in FIG. 5, to a much enlarged scale.
FIG. 6 is an end elevation of the component at the left end of the assembly part shown in FIG. 5.
FIG. 7 is a right end elevation of the assembly part shown in FIG. 5.

The stabilizer 206 has three circumferentially distributed grip pads 301 (shown in end view in FIG. 7) which can be forced radially outwards by pressurising the undersides of pistons 303 which underlie the pads 301 (more clearly visible in the enlarged fragmentary view of FIG. 5A). Pressurisation for the pistons 303 comes from a generally annular axial multi-piston swashplate pump 305 whose annular swashplate or camring 307 is selectively rotatable under the control of a clutch 309 which taps power from the shaft 232 by a way of an Oldham coupling 311. The clutch 309 is operated when it is required to extend the grip pads 301 to anchor the stabiliser 206 in the previously drilled well bore for measurement and possible alteration of drilling direction. The pump 305 has an oil reservoir 313 defined between an inner sleeve 315 and the inside of the tubular support 250. The reservoir 313 is capped by an annular piston 317 (shown enlarged in FIG. 5B) which "floats" along the sleeve 315 to provide pressure compensation.

When it is required to de-anchor the stabiliser 206, the grip pads 301 are retracted by opening the clutch 309 so as to disconnect the pump 305 from the shaft 232 and thereby allow the underside of the pad-extending pistons 303 to depressurise (either through natural leakage or through a controlled leak (not shown) whereupon the pads 301 are "knocked in" by impacts and/or sustained pressure against the bore, compounded if necessary or desirable by a suitable arrangement of springs (not shown) acting on the grip pads 301 to urge them radially inwards.

FIG. 5 also shows the uphole end of the assembly 200, where the shaft 232 is provided with a connector 321 for attachment to a rotatable drillstring 323. The connector 321 is rotatably supported on the uphole end of the support 250 by means of a combined radial and thrust bearing system 325. The downhole end of the section of the shaft 232 shown in FIG. 5 is formed with a spline connector 327 for rotational coupling to the remainder of the shaft 232. The coupling 327 appears at the extreme left of FIG. 5, and in end view in FIG. 6.

Figure 8:
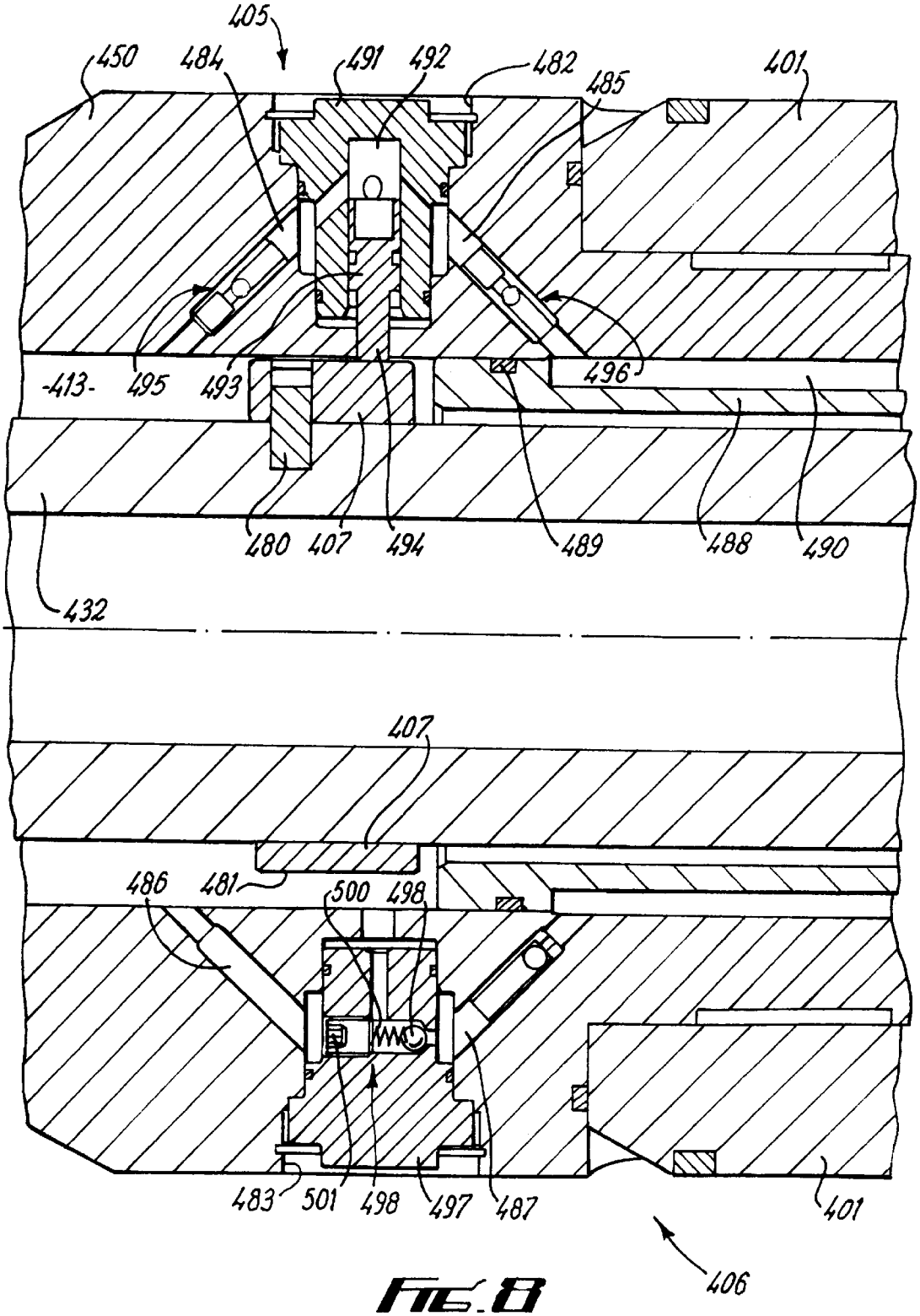
FIG. 8 is a sectional elevation of an assembly fragment having a form which is an alternative to that shown in FIG. 5A.

Referring now to FIG. 8, this shows part of a stabiliser 406 and its associated hydraulic pump system 405, together constituting an anchoring arrangement which is an alternative to that shown in FIG. 5A. The reference numerals used in FIG. 8 are selected in accordance with a convention which relates the FIG. 8 reference numerals to reference numerals utilised in preceding Figures in the same manner as the reference numerals in FIGS. 4A and 4B relate to the reference numerals of FIGS. 2A and 2B, and the reference numerals of FIGS. 2A and 2B relate in turn to the reference numerals of FIGS. 1A and 1B.

In FIG. 8, only the lower ends of the radially extensible grip pads 407 are shown, their respective pistons for inducing outward movement also being omitted from FIG. 8.

Whereas in the preceding embodiment (FIGS. 5–7), the grip pads 301 were set directly into respective recesses formed in the body of the further support 250, in the FIG. 8 embodiment the grip pads 401 are partly mounted (at their lower ends) in grip pad retainers (not shown) screwed onto the exterior of the support 450.

Also, whereas the pump 305 of the preceding embodiment was an axial-piston swashplate pump, the pump 405 in the FIG. 8 embodiment is an eccentric-driven radial piston pump. A hardened steel ring 407 is fitted around the shaft 432, the ring 407 being keyed to the shaft 432 by means of a peg 480 radially extending part-through both ring and shaft. Although the outer surface of the shaft 432 and the inner diameter of the ring 407 are concentric about the centre-line of the shaft 432 (ie at a constant radius from the rotation axis of the shaft 432), the ring 407 has a peripheral surface 481 which is eccentric to the rotation axis. In other words, although peripheral surface 481 of the ring 407 is circular, it is not at a constant radius from the rotation axis of the shaft 432, and tracing a circumferential path around the periphery of the ring 407 will involve cyclic variation between a maximum radial displacement and a minimum radial displacement.

The body of the further support 450 is formed with a plurality of radially extending through bores 482 and 483 (two of which are visible in FIG. 8) which are circumferentially distributed around the support 450, and are axially aligned with the ring 407. Side bores 484 and 485 extend both radially and axially from the bore 482 to intersect the inner surface of the support 450, for a purpose to be detailed subsequently Similarly, side bores 486 and 487 extend both radially and axially from the bore 483 to intersect the inner surface of the support 450, for a purpose to be detailed subsequently.

The annular space between the inner surface of the support 450 and the outer surface of the shaft 432 is hydraulically divided by a sleeve 488 sealed to the inner surface of the support 450 by means of an O-ring 489 and other seals (not visible in FIG. 8) The volume 490 on the outside of the sleeve 488 forms a gallery linking the side bores 485 and 487 to the undersides of the pistons (not shown in FIG. 8) which selectively force the grip pads 401 to extend radially outwards from the support 450 when anchoring is required The volume on the inside of the sleeve 488 is contiguous with the volume axially below the ring 407 (the left of the ring 407 as viewed in FIG. 8) and constitutes the reservoir 413 holding hydraulic fluid as a supply for the pump 405 as will now be detailed.

A circular plunger housing 491 is mechanically secured and hydraulically sealed into the bore 482. The housing 491 has a radially extending central bore 492 holding a reciprocable piston 493 which is slidingly sealed to the housing bore 492. The radially inner end 494 of the piston 493 extends radially through the radially inner end of the bore 482 and is held in contact with the eccentric ring periphery 481 by means of a coiled compression spring (omitted from FIG. 8) housed in the bore 492 above the radially outer end of the piston 493. As the shaft 432 rotates relative to the further support 450, the ring 407 rotates relative to the plunger housing 491 such that the eccentric periphery 481 reciprocates the piston 494 within its housing bore 492.

The side bore 484 communicates the reservoir 413 with the housing bore 492 by way of a one-way valve 495 constituted by a spring-loaded ball arranged such that the valve 495 functions as an automatic inlet valve for the piston pump constituted by the combination of the piston 493 and the bore 492 (the pump being driven by relative rotation of the ring 407).

The side bore 485 communicates the bore 492 with the pressure gallery 490 leading to the pistons for extending the grip pads 401, by way of a one-way valve 496 constituted by a spring-loaded ball arranged such that the valve 496 functions as an automatic outlet valve for the piston pump constituted by the combination of the piston 493 and the bore 492.

A circular housing 497 is mechanically secured and hydraulically sealed into the bore 493. The housing 493 hydraulically links the pressure gallery 490 to the reservoir 413 by way of the side bores 487 and 486, through a housing-mounted pressure-limiting safety valve 498 constituted by a ball 499 loaded by a spring 500 whose force (and hence the valve's blow-down pressure) is adjustable by a screw 501. The safety valve 498 operates to prevent excessive pressurisation of the gallery 490 by limiting its pressure with respect to the pressure in the reservoir 413 (held about equal to ambient pressure in the borehole by means of a pressure-balancing floating annular piston (not shown) located between the shaft 432 and the support 450 to define one end of the reservoir 413).

Not shown in FIG. 8 is a calibrated bleed which couples the relatively high pressure gallery 490 to the relatively low pressure reservoir 413 such that there is a sustained leak of hydraulic fluid from the high pressure side of the pump 405 to the low pressure side of the pump 405, the rate of leakage being substantially predetermined and preferably adjustable The function of this leak is to de-pressurise the gallery 490 when the output of the pump 405 is low or zero, ie when the shaft 432 is turning slowly or is stationary with respect to the body of the support 450. However, the bleed is selected to be such that when the shaft 432 is rotating relatively rapidly with respect to the support 450 whereby the volumetric output of the pump 405 is relatively high, the leakage of the bleed is insufficient to drain the entire output of the pump 405 and pressure builds up on the gallery 490.

When it is desired to extend the grip pads 401 in order temporarily to anchor the further support 450 to a previously drilled wellbore (not indicated in FIG. 8), the rotational speed of the shaft 432 with respect to the support 450 is increased from standstill or a very low rotational speed, up to a relatively high speed at which the volumetric output of the pump 405 sufficiently exceeds the volumetric leakage rate of the above-described pressure bleed that pressure builds up in the gallery 490, such that the pistons (not shown in FIG. 8) between the gallery 490 and the grip pads 401 are forced radially outwards with respect to the longitudinal axis of the stabiliser 406, eventually to cause the grip pads 401 to contact the wellbore and anchor the stabiliser 406 at that location.

When it is desired to retract the grip pads 401 from their wellbore-contacting extended positions to respective radially inwards positions so as to de-anchor the stabiliser 406, it is sufficient to reduce the rotational speed of the shaft 432 by a suitable amount, eg by bringing the shaft 432 to a standstill. Shaft speed reduction reduces the output of the pump 405 below the level at which the pump output is adequate to overcome losses through the calibrated bleed, and consequently the gallery 490 depressurises through the bleed. This depressurisation reduces and eventually substantially eliminates pad-extending force from the pad-extending pistons, allowing the pads 401 to retract radially inwards into the support 450. Pad retraction is preferably assisted by springs (not shown in FIG. 8) which are arranged to exert radially inwardly directed forces on each of the pads 401.

As an alternative to use of the above-described controlled bleed in conjunction with slowing or stopping rotation of the shaft 432 in order to retract the grip pads 401 from their wellbore-contacting extended positions to respective radially inwards positions so as to de-anchor the stabiliser 406, the controlled bleed may be replaced by a remotely-controllable valve (not shown in FIG. 8) which couples the gallery 490 to the reservoir 413. The remotely-controllable valve may (for example) be a solenoid valve or any other suitable form of valve whose ability to pass or block the flow of fluid can be selectively controlled from a distance, eg from the surface installation at the top of the well. Closing of the remotely-controllable valve while the shaft 432 is rotating will allow the pump 405 to pressurise the gallery 490 and so to extend the grip pads 401. Opening of the remotely-controllable valve (with or without slowing or stopping rotation of the shaft 432) will dump pressure from the gallery 490 to the reservoir 413, thereby allowing the grip pads 401 to retract radially inwards from the wellbore. Use of the remotely-controllable valve instead of the controlled bleed requires the addition of a control link to the surface (or other valve-controlling location) but has the advantage that rotation of the shaft 432 can be continued during retraction of the grip pads 401.

Although only one pump-containing bore 482 is shown in FIG. 8, a plurality of such piston pump units could be provided, each in its respective bore (circumferentially distributed around the support 450 in axial alignment with the eccentric ring 407 which radially reciprocates the respective piston of each such pump unit). The pump 405, the safety valve 498, and the calibrated bleed are conveniently housed within the greater radial extent of the upper-end shoulders of the three blades of the stabiliser 406 (which has an overall arrangement similar to that of the stabiliser 206 as shown in FIG. 7).

Figure 9:
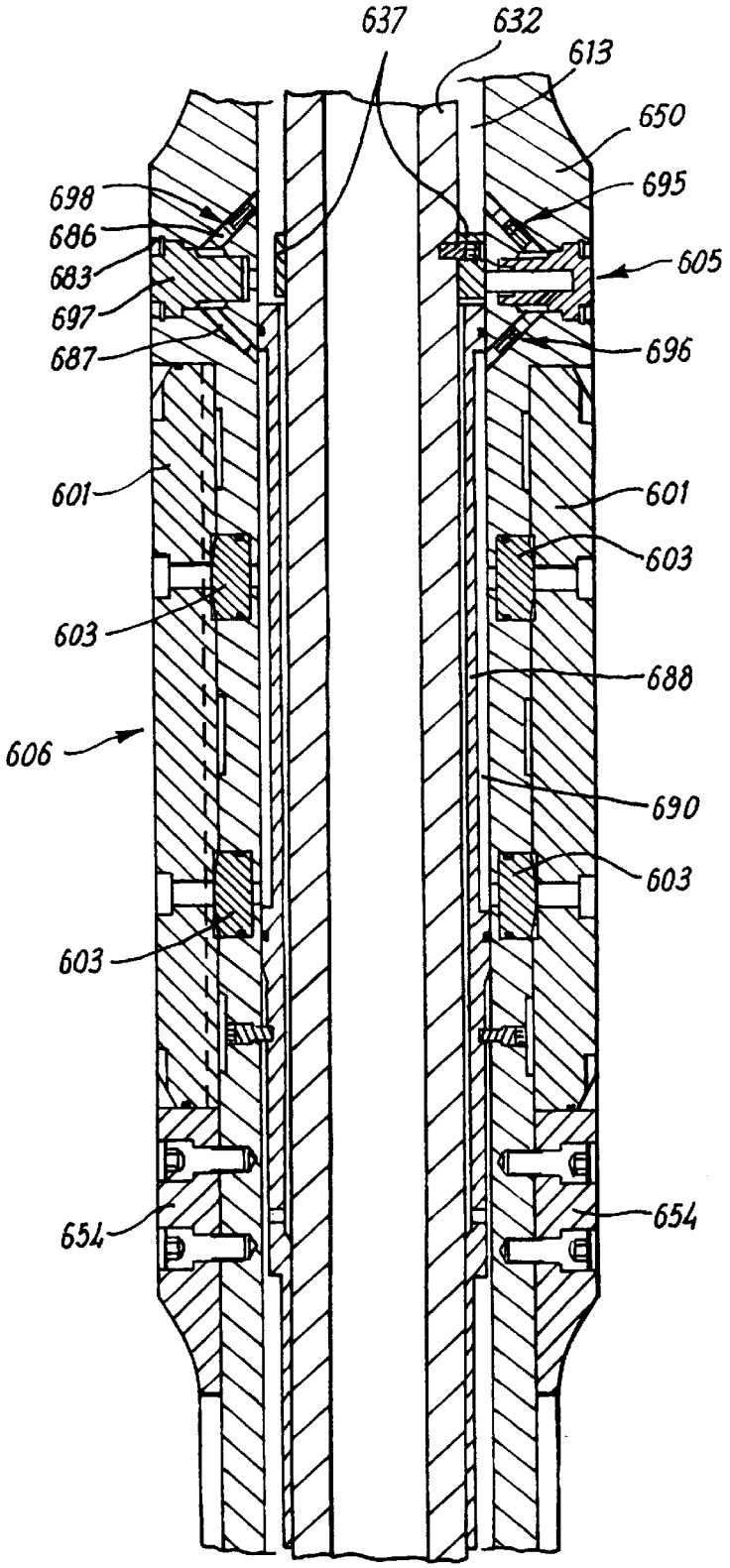
FIG. 9 is a sectional elevation of an assembly fragment having a form which is a further alternative to that shown in FIG. 8.
Figure 10:
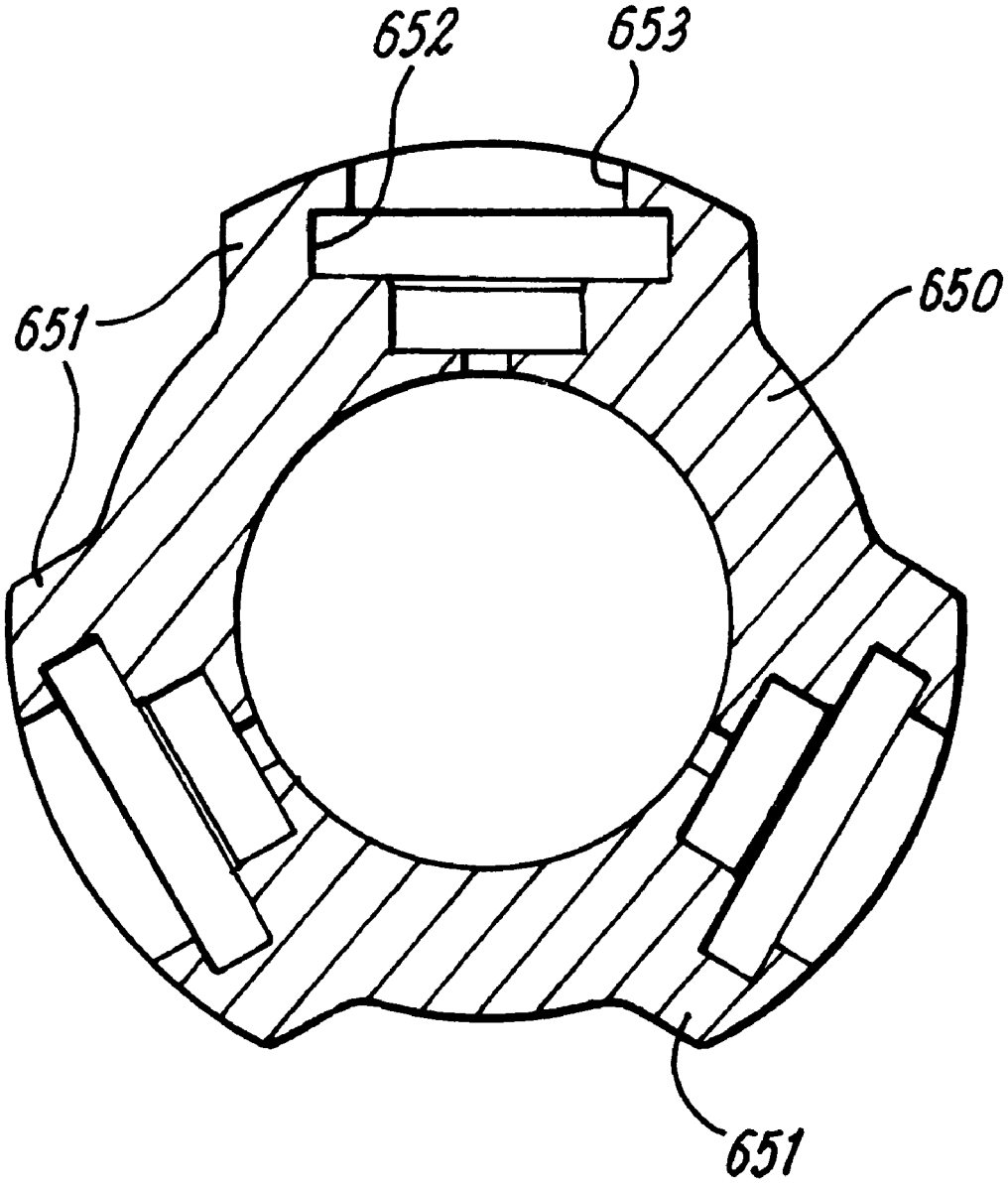
FIG. 10 is a transverse cross-section of the arrangement shown in FIG. 9.

Referring now to FIGS. 9 and 10, FIG. 9 is a longitudinal section of a preferred embodiment form of a stabiliser 606 which is generally similar to the stabiliser 406 of FIG. 8 (but incorporating certain detail differences which will be described below), the stabiliser 406 of FIG. 8 being part of a directional drilling alignment assembly (not shown in the drawings) in the same manner that the stabiliser 206 of FIG. 5A is part of the directional drilling alignment assembly 200 of FIG. 4A. FIG. 10 shows a transverse cross-section of the main body of the stabiliser 606, and will be detailed subsequently. The reference numerals which are applied to the components illustrated in FIGS. 9 and 10 are based on the reference numerals applied to the components illustrated in FIG. 8 in the same way that the FIG. 8 reference numerals are based on those of preceding FIGS.

In view of the many similarities of the stabiliser 606 to the stabiliser 406, the following description of FIG. 9 will concentrate on those parts of the stabiliser 606 which differ significantly from the stabiliser 406. (Operation of the stabiliser 606 is substantially identical to operation of the stabiliser 406).

In the stabiliser 606 as illustrated in FIG. 9, the pressure-limiting safety valve 698 is transferred from the housing 697 to the side bore 686. (The side bore 687 is simply a through passage for hydraulic fluid). The housing 697 is devoid of internal passages (in contrast to the housing 497), with hydraulic fluid flowing around the solid housing 697 by way of a portion of the bore 683 (in which the housing 697 is mounted and sealed) having a local diameter somewhat larger than the local diameter of the housing 697.

Although only two grip pads 601 are shown in FIG. 9, there are in fact three such grip pads, each mounted in a respective one of three symmetrically arranged stabiliser blades 651, as shown in FIG. 10 (compare FIG. 10 with FIG. 7). In this respect, FIG. 9 is actually a section in two planes at 120° to one another, being shown as an apparent (but false) flat section for convenience and clarity.

FIG. 10 shows a transverse cross-section of the stabiliser body 650, minus all other components. The grip pads 601 are each of an inverted T shape (in the radially outward direction) with side flanges (not shown) which fit in side grooves 652 formed in each of the longitudinally elongated slots 653 cut out of the blades 651 to accommodate the grip pads 601. These side flanges have a thickness in the radial direction (when assembled into a complete stabiliser 606) that is sufficiently less than the radial depth of the side grooves 652 as to allow the grip pads 601 to move radially in and out of the slots 652 between their fully retracted and fully extended positions.

The grip pads 601 are fitted in the slots 653 by being slid longitudinally into the slots 653 via cut-away lower ends of the blades 651. The fitted grip pads 601 are retained, and the cut-away lower ends of the blades 651 are restored, be means of suitably shaped retainers 654 (FIG. 9) fastened to the stabiliser body 650.

Springs (not shown) are preferably fitted to link the grip pads 601 and the stabiliser body 650 in a manner which urges the grip pads 601 radially inwards to their respective retracted positions when the pad-extending pistons 603 are not pressurised on their radially inwards sides by delivery from the pump 605 via the pressure gallery 690. Such springs could take the form of corrugated strips of spring steel (not shown) located between the radially outer faces of the side flanges on the grip pads 601 and the radially outer sides of the side grooves 652, the side grooves being dimensioned to accommodate such springs in addition to the thickness (in the radial direction) of the grip pad side flanges plus the clearance necessary to allow full radial movement of the grip pads 601 between their fully retracted and fully extended positions.

Figure 11:
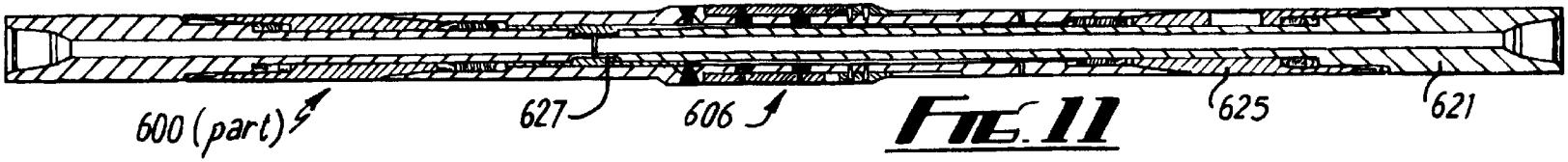
FIG. 11 is a longitudinal section of a directional drilling alignment assembly incorporating the arrangement of FIG. 9.

The stabiliser 606 is utilised in a directional drilling alignment assembly 600 generally similar to the assembly 200 as shown in FIGS. 4A and 5, the assembly 600 incorporating the stabiliser 606 being partially illustrated in FIG. 11 (corresponding to the central part of FIG. 4A, with the right half of FIG. 11 corresponding to FIG. 5).

Figure 12:
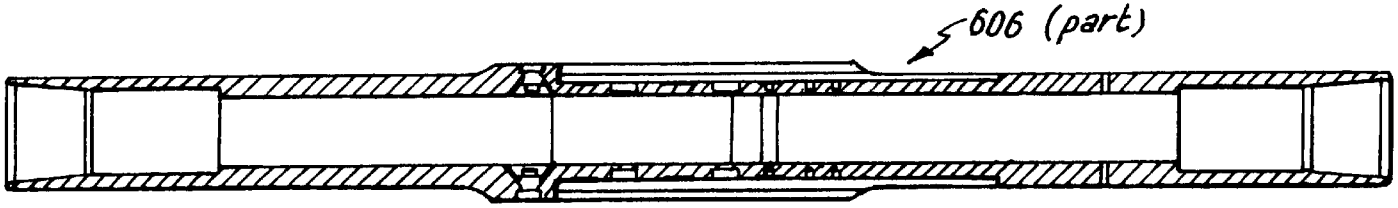
FIG. 12 is a longitudinal section of the outer part of the FIG. 9 arrangement as incorporated in the FIG. 11 assembly.
Figure 13:
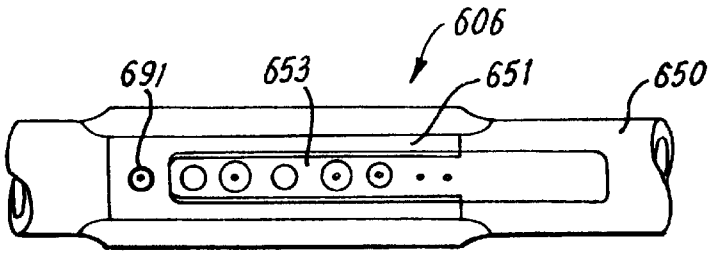
FIG. 13 is a plan view of part of the FIG. 12 arrangement.

The outer components of the stabiliser 606 are shown in section in FIG. 12 (which is a bi-planar section in the same convention as FIG. 9), and in plan in FIG. 13 (wherein the grip pads 601 are omitted in order to show the interior of the pad-accommodating slots 653).

Figure 14A:
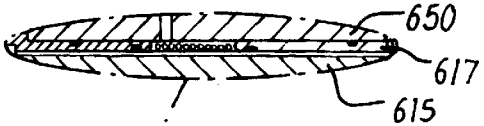
FIG. 14A is an enlarged view of part of the FIG. 14 sub-assembly.
Figure 14:
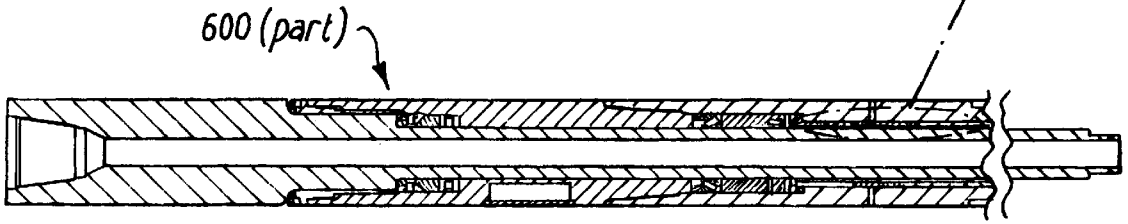
FIG. 14 is a longitudinal section of the lower (left) end sub-assembly of the FIG. 11 assembly.

The alignment assembly 600 below the stabiliser 606 (the left end as shown in FIG. 11) is shown to an enlarged scale in FIG. 14, with part of FIG. 14 being shown to a further enlarged scale in FIG. 14A. Particularly detailed in FIG. 14A is the pressure-balancing annular piston 617 (compare FIG. 14A with FIG. 5B).

Figure 15:
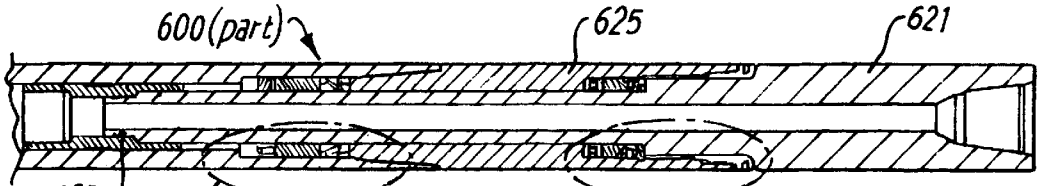
FIG. 15 is a longitudinal section of the upper (right) end sub-assembly of the FIG. 11 assembly.
Figure 15B:
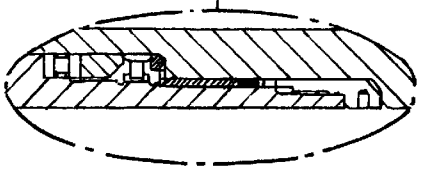
FIGS. 15A and 15B are enlarged views of parts of the FIG. 15 sub-assembly.
Figure 15A:
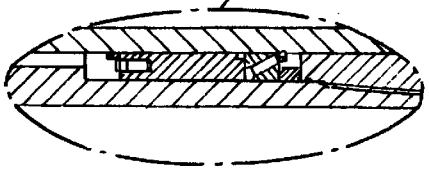

The alignment assembly 600 above the stabiliser 606 (the right end as shown in FIG. 11) is shown to an enlarged scale in FIG. 15 (which generally corresponds to the right part of FIG. 5). The combined radial and axial thrust bearings in the FIG. 15 sub-assembly are shown to an enlarged scale in FIG. 15A in the form of a tapered roller bearing, while the separate radial and axial thrust bearings (together with a seal assembly) are shown to an enlarged scale in FIG. 15B in the form of single-row roller bearings.

While certain alternatives, modifications and variations have been described above, the invention is not restricted thereto, and other alternatives, modifications, and variations can be adopted without departing from the scope of the invention as defined in the appended claims.

I claim:

1. A shaft alignment system comprising:

first shaft support means for supporting a shaft, said first shaft support means having a first longitudinal axis and being rotatable about said first longitudinal axis, second shaft support means for supporting the shaft, said second shaft support means having a second longitudinal axis and being rotatable about said second longitudinal axis, and bearing means for rotatably coupling said first shaft support means to said second shaft support means, said bearing means having a bearing rotation axis, said bearing means being arranged with respect to said first and second shaft support means such that said bearing rotation axis is aligned at a first non-zero angle with respect to said first longitudinal axis and at a second non-zero angle with respect to said second longitudinal axis whereby relative rotation of said first and second shaft support means about their respective longitudinal axes varies the relative angular alignment of said first and second longitudinal axes.

2. A system as claimed in claim 1 wherein said first and second shaft support means and said bearing means are mutually disposed such that said bearing rotation axis intersects each of said first and second longitudinal axes.

3. A system as claimed in claim 2 wherein said first and second shaft support means and said bearing means are mutually disposed such that said first and second longitudinal axes mutually intersect.

4. A system as claimed in claim 1 wherein said first and second non-zero angles are selected from angles in the range of 1°–3°.

5. A system as claimed in claim 1 wherein said first and second non-zero angles are selected to be mutually equal whereby in one relative rotational position of the first and second shaft support means said first and second longitudinal axes are mutually parallel.

6. A system as claimed in claim 1 wherein said first shaft support means comprises first shaft bearing means for supporting a first section of the shaft for rotation about a first shaft rotation axis coaxial with said first longitudinal axis in the vicinity of said first shaft bearing means and said second shaft support means comprises second shaft bearing means for supporting a second section of the shaft for rotation about a second shaft rotation axis coaxial with said second longitudinal axis in the vicinity of said second shaft bearing means.

* * * * *